US006783199B2

(12) United States Patent
Parrott

(10) Patent No.: US 6,783,199 B2
(45) Date of Patent: Aug. 31, 2004

(54) THERMAL BARRIER FOR A CABINET

(76) Inventor: John C. Parrott, 10187 Ramona Dr., Casa de Oro, CA (US) 91977

( * ) Notice: Subject to any disclaimer, the term of this patent is extended or adjusted under 35 U.S.C. 154(b) by 0 days.

(21) Appl. No.: 09/902,910

(22) Filed: Jul. 10, 2001

(65) Prior Publication Data

US 2003/0038570 A1 Feb. 27, 2003

(51) Int. Cl.[7] ..... A47B 96/04
(52) U.S. Cl. ..... 312/407; 62/248
(58) Field of Search ..... 312/401, 405, 312/407, 1, 3–6, 405.1, 407.1, 116; 62/248, 249, 377, 449, 256, 265; 211/180; 160/184, 332

(56) References Cited

U.S. PATENT DOCUMENTS 2,041,258 A * 5/1936 Mitchell ..... 156/10
4,109,484 A * 8/1978 Cunningham ..... 62/256
4,288,992 A * 9/1981 Eliason ..... 62/256
4,313,485 A * 2/1982 Gidge et al. ..... 160/332
4,400,046 A * 8/1983 Karashima ..... 312/236
4,429,548 A * 2/1984 Layne ..... 62/255
4,539,819 A * 9/1985 Alba et al. ..... 62/78
4,550,760 A * 11/1985 Gidge et al. ..... 160/328
5,127,460 A * 7/1992 Abadi et al. ..... 160/332
5,431,490 A * 7/1995 Edwards ..... 312/405
5,520,237 A * 5/1996 Finkelstein et al. ..... 160/184
D439,914 S * 4/2001 Trulaske, Sr. ..... 312/236 X

* cited by examiner

*Primary Examiner*—Jennifer E. Novosad
(74) *Attorney, Agent, or Firm*—David B. Waller & Associates

(57) ABSTRACT

A thermal barrier for a cabinet having a door storage area comprising a curtain having vertical slits dividing the curtain into flaps; an attachment device for securing the curtain within the cabinet; and a displacement apparatus for displacing at least one of the flaps from contact with adjacent flaps when the cabinet is closed allowing air within the cabinet to circulate to the door storage area.

32 Claims, 8 Drawing Sheets

THERMAL BARRIER FOR A CABINET

TECHNICAL FIELD

The present invention relates generally to thermal barriers for use in a temperature controlled cabinet and more particularly to a thermal barrier curtain that allows the air from within the cabinet to circulate to the storage area of the cabinet door.

BACKGROUND OF THE INVENTION

Commercial businesses as well as private homes commonly use refrigerators to preserve the freshness of food by regulating the temperature to a level sufficient to slow food aging and to reduce contamination by bacteria. Consumption of food contaminated with bacteria often results in what is generally called food poisoning and is a common problem with improperly stored foods.

Shell eggs are among the most nutritious foods and are recommended as part of a healthy diet, but they are extremely susceptible to the bacteria Salmonella Enteriditis. Salmonella Enteriditis attaches to the shell surface during the egg laying process or when the egg comes in contact with feces prior to collection. Much of the bacteria is removed during the washing and sanitizing process prior to sale, however as with most processes, they may not eradicate all of the bacteria. In addition if an egg rests against already contaminated food or is handled with contaminated hands, the bacteria may be reintroduced on the eggshell. Bacterial growth is facilitated when condensation accumulates on the exterior of the eggshell surface often times resulting when the refrigerator door is opened. Because of this several government agencies recommend not leaving eggs at ambient temperature for more than two hours after refrigeration.

The safety of shell eggs has been a long term problem and has prompted the Federal Drug Administration (FDA), Animal Plant Health Inspection Service (AIPHIS), Food Safety and Inspection Service (FSIS), Agricultural Research Service (ARS), National Agricultural Statistics Service (NASS), as well as state agriculture departments and state and local health departments to cooperate to ensure the safety of shell eggs from farm to table. On Aug. 27, 1999 the FSIS ruled that shell eggs packed for consumers must be stored and transported under refrigeration at an ambient temperature not to exceed 45° F. However, the recommendation for home storage of eggs by the FSIS is even stricter. The FSIS recommends consumers transport eggs immediately to a refrigerator and store them immediately at or below 40° F. to decrease the likelihood of Salmonella Enteriditis contamination.

The FSIS suggests keeping eggs within the coldest region of the refrigerator and not in the storage door. However, even with this warning many consumers still keep their eggs in the door of the refrigerator. Moreover, many manufacturers have incorporated removable egg trays that fit in the storage door and still others have molded egg trays built into the storage door. These conveniences offered by manufacturers further encourage consumers to store eggs in the door of the refrigerator.

Nearly every home in the U.S. has a refrigerator, and the power they require add to the already high demand for electricity. There is a constant tension between the FSIS recommendations, which encourage adequate refrigeration to ensure food safety and the Department of Energy (DOE) concerns that stress energy conservation.

The Association of Home Appliance Manufacturers ("AHAM") has adopted a standard voluntary testing protocol (ANSI/AHAM HRF-1-1988) recognized by the American National Standards Institute ("ANSI") for testing the efficiency of home refrigerators. The protocol measures the temperature at strategic points in the interior refrigerator and freezer chambers over time while opening and closing the door at defined intervals. AHAM standards allow consumers to identify which refrigerators use less power and which better maintain the set temperature under conditions of normal consumer use (i.e. when refrigerator doors are frequently opened and closed during the day).

Various forms of thermal barriers have been developed in an attempt to reduce the power consumption by refrigerators. Thermal barriers reduce the interaction between the cold interior air of the refrigerator and the warmer outside ambient air. The result is a refrigerator that uses less power to retain the set temperature by reducing loss of the cold air when the door is open. Examples of such known devices are disclosed in U.S. Pat. Nos. 2,041,258, 4,109,484, 4,288,992, 4,313,485, 4,400,046, 4,429,548, 4,539,819, 5,431,490. Generally, these devices create a barrier between the inner cabinet and the outer environment by providing rigid drawers or doors, a draped over horizontal curtain, or a hanging vertical curtain. However, these devices are intended and designed to isolate a refrigerated chamber without a storage door. Unfortunately, a storage door is a common feature in many brands of household and industrial refrigerators.

U.S. Pat. No. 5,431,490 ("'490") has incorporated the use of a hanging vertical thermal barrier with vertical slits in a refrigerator having a storage door. Unfortunately the '490 invention does not continually retain a storage door temperature at or below the FSIS requirement of 45° F. when performing the AHAM test.

As previously discussed, current devices allow the efficient storage of food by creating thermal barriers in refrigerators that do not have storage doors. However, these thermal barriers are unable to maintain temperatures in food storage doors that meet the FSIS recommendations. Therefore, there is a need for a thermal barrier that allows efficient cooling of the storage door while minimizing the loss of coolness from the freshness chamber when the door is open.

SUMMARY OF THE INVENTION

Figure 1:
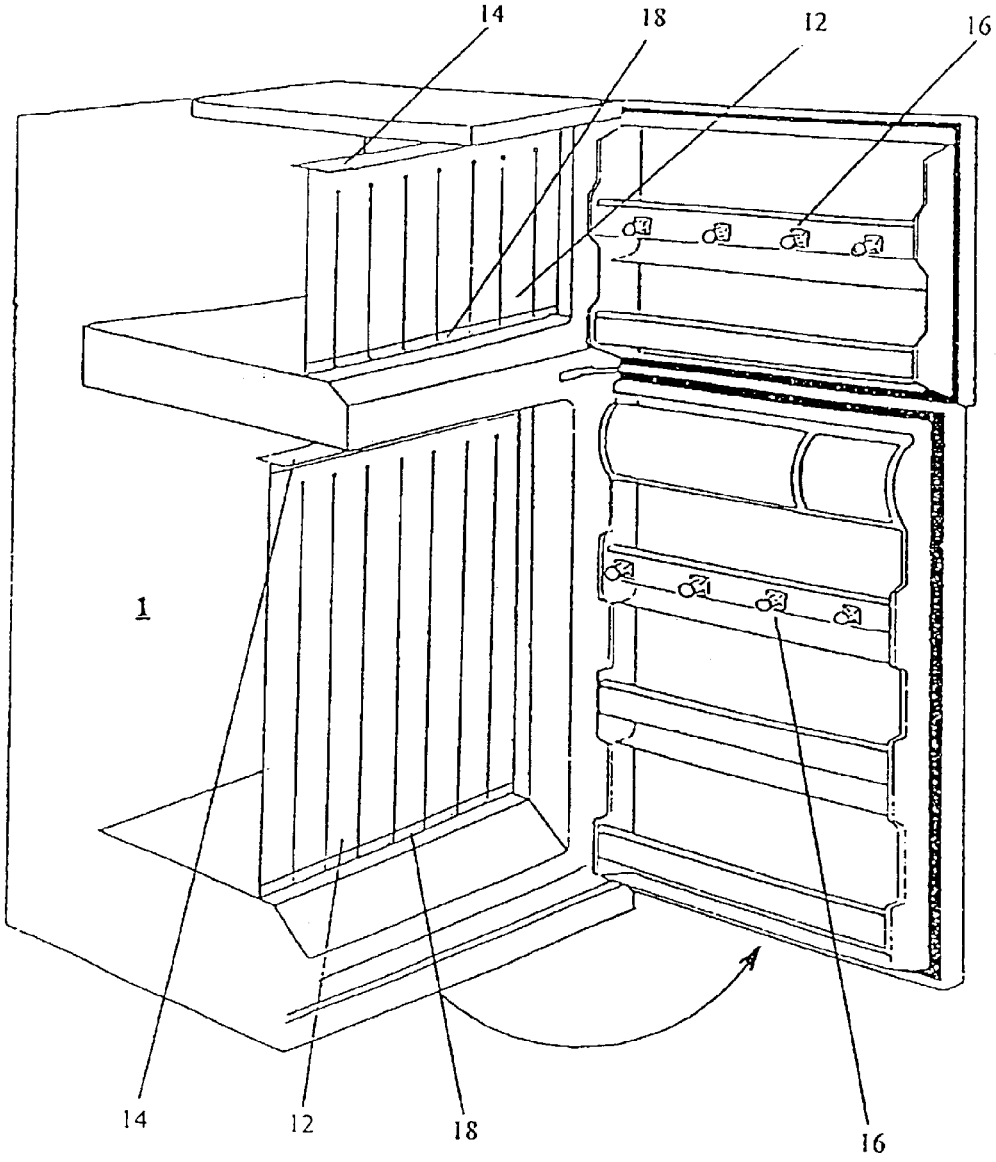
FIG. 1 is a perspective view of a device of the present invention having a protrusion strip mounted in a refrigerator demonstrating alignment of the flaps when the cabinet door is opened.
Figure 2:
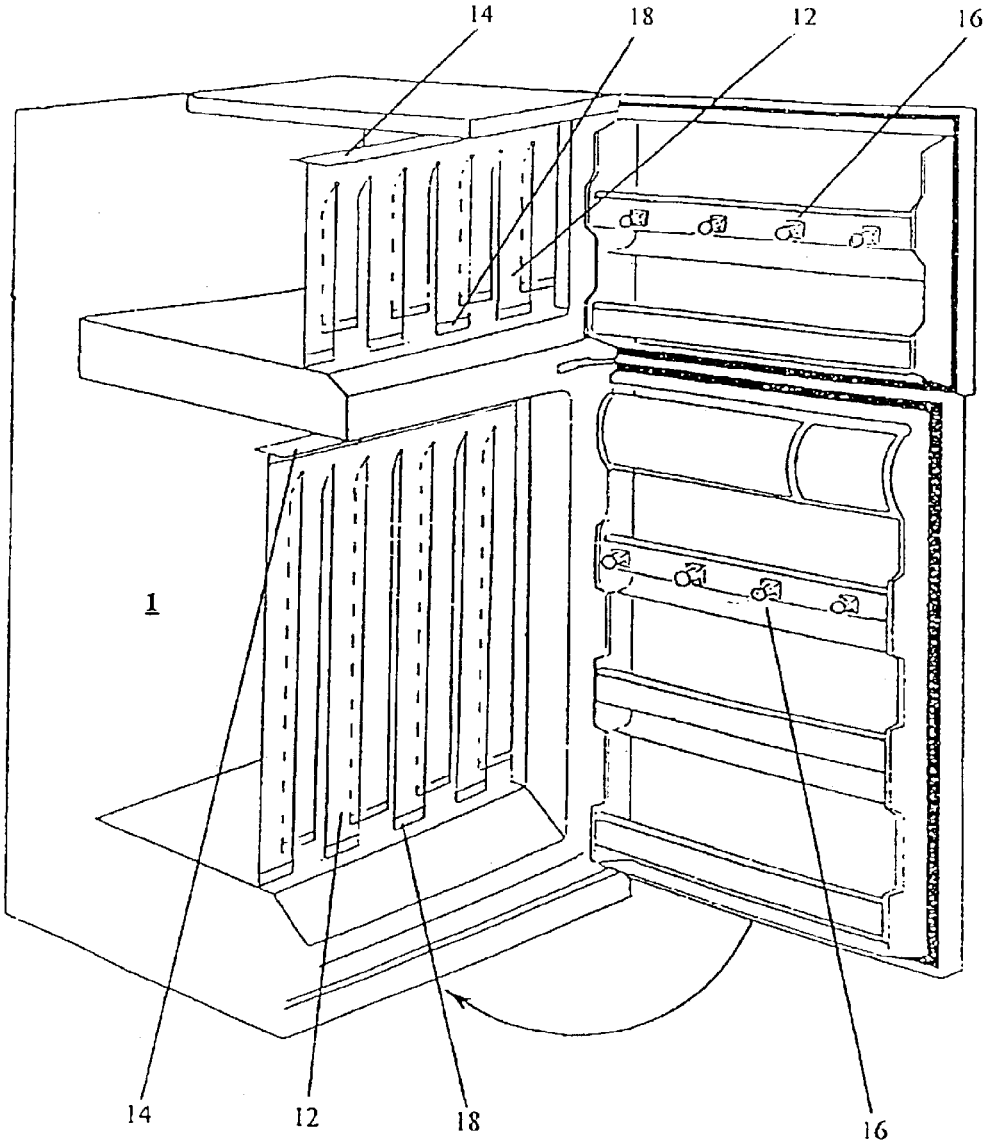
FIG. 2 is a perspective view of a device of the present invention mounted in a refrigerator demonstrating the displacement of alternating flaps by a protrusion strip when the cabinet door is closed.

In accordance with the present invention a thermal barrier for a cabinet is provided having a door storage area comprising a curtain having vertical slits dividing the curtain into flaps; an attachment device for securing the curtain within the cabinet; and a displacement apparatus for displacing at least one of the flaps from alignment with adjacent flaps when the cabinet is closed allowing air within the cabinet to circulate to the door storage area. The flaps may overlap adjacent flaps, the flaps may be constructed of a translucent material, and the device may further comprise stabilizing adapters affixed to the flaps such as weights.

In one embodiment of the present invention the attachment device may further comprise a mounting means and a connecting rod. The mounting means may be a bracket that may be mounted on the upper surface of the cabinet or on the two opposing sides of the cabinet. The connecting rod may be adjustable in length and may be rotatably affixed to the mounting means. At least one flap may be connected to the connecting rod such that when the connecting rod rotates the at least one flap is displaced from alignment with adjacent flaps.

In another embodiment the displacement apparatus may comprise at least one protrusion that contacts at least one flap displacing the flap from alignment with adjacent flaps when the cabinet is closed.

In yet another embodiment the displacement apparatus comprises an activation shaft connected to the connecting rod such that when the cabinet is closed the activation shaft activates the connecting rod rotating the connecting rod causing the displacement of at least one flap from alignment with said adjacent flaps.

In still another embodiment of the present invention the displacement apparatus comprises an electrical motor connected to the connecting rod and a light sensor such that when the cabinet is closed the sensor activates the motor to rotate the connecting rod causing the displacement of at least one flap from alignment with the adjacent flap. Alternatively, the sensor may be activated when the door is opened to rotate the connecting rod causing the at least one displaced flap to come in alignment with non-displaced adjacent flaps.

In another aspect of the invention a thermal barrier for a cabinet having a door and an inner chamber, the door having a storage area and the inner chamber having an upper surface, a lower surface and two opposing side walls is disclosed comprising a curtain having vertical slits dividing the curtain into flaps; an attachment device for securing the curtain to the upper surface; and a displacement apparatus for displacing at least one of the flaps from alignment with adjacent flaps when the cabinet is closed allowing air within the cabinet to circulate to the storage area within the door. The attachment device may secure the curtain from the two opposing sidewalls.

In other aspects of the present invention a kit is disclosed comprising a thermal barrier described above as well as in another aspect of the present invention a method for reducing the temperature within the door storage area utilizing a thermal barrier described above.

DETAILED DESCRIPTION OF THE INVENTION

There are several disadvantages of the anti-convection current curtain of the '490 patent used to maintain the temperature within a controlled temperature cabinet. Specifically the anti-convection current curtain disclosed in the '490 patent does not efficiently or effectively allow cooling of the door storage area because the curtain seals this area from the freshness chamber. In particular the curtain is fastened to the cabinet above the freshness chamber preventing circulation above the curtain. Further the curtain extends the width of the freshness chamber preventing circulation around the curtain. In addition when the door is closed the shelf pushes against the curtain sealing the storage area at the contact point between the shelf and the curtain preventing circulation through the vertical slits. Lastly since the shelves are of solid configuration the refrigerated air is prevented from circulating upward into the storage area. Consequently the anti-convection curtain effectively and efficiently prevents cooling of the door storage area by trapping and sealing ambient temperature air within the storage area.

The securing technique for placement of the anti-convection curtain disclosed in the '490 patent interferes with the seal between the door and the cabinet and may allow the door to remain partially open.

The securing technique disclosed in the '490 patent interferes with the seal between the door and the cabinet by reducing the attraction between the magnetic seal and the metal cabinet. The curtain disclosed in the '490 patent is secured along the outer region of the cabinet by a double-sided adhesive tape. When the door closes, the curtain is compressed between the magnetic seal and the cabinet causing the magnetic forces to weaken. The weakened forces allow the barrier to push the door open. The result is a cabinet that does not seal allowing the air from the inner chamber to leak out.

Placement of the anti-convection current curtain on the exterior surface of the cabinet causes the flaps to swing outward and side to side when the door is opened. In addition when the door is closed the lower portion of the curtain is pushed inward into the freshness chamber by the storage shelf. When the door is opened the curtain is released and swings along an arced path beyond the plane of the freshness chamber allowing air to escape below the curtain. Further, since the door opens along a hinge, the flap opposite the hinge is released first causing the flaps to swing individually. When flaps swing individually air is also allowed to pass through the gaps formed in the curtain. This problem may be enhanced when in a humid environment primarily because the moisture may cause the curtain to adhere to the storage shelf with the door when opened.

In addition, when the door is closed the air within the freshness chamber is compressed and pushes outward allowing them to become pinched between the door and cabinet. Like the securing technique, the pinched flaps weaken the magnetic seal between the door and the cabinet and may allow refrigerated air to escape and may also prevent the door from closing. In addition pinching may cause permanent damage to the curtain. The result is a curtain that no longer hangs properly allowing air to escape from the freshness chamber.

Referring now more specifically to FIG. 1 the curtain (12) of the present invention does not seal the storage area within the door from the freshness chamber (10) when the door is closed because by displacing at least one flap from alignment with adjacent flaps, air is free to circulate through the curtain (12) when the door is closed.

The curtain disclosed in the present invention does not interfere with the magnetic seal between the cabinet (1) and the door because the curtain of the present invention is positioned on the interior of the cabinet covering the freshness chamber (10). Therefore the seal is not compromised with the present invention.

The curtain (12) disclosed in the present invention is not displaced when the door is opened because the curtain (12) does not rest against the storage area shelves when the door is closed.

In addition when the displacement apparatus (16) is a rotating connecting rod the displacement occurs by rotation, and rotation minimizes the angle between the attachment device (14) and the lower portion of the displaced flap. When the displacement apparatus (16) is a protrusion strip, the angle between the lower portion of the at least one displaced flap and the attachment device (14) is minimized by placing the curtain (12) within the freshness chamber.

The displacement apparatus (16) disclosed in the present invention is not adaptable to the device disclosed in the '490 patent.

In particular a rotating rod can not be adapted to the cabinet of the '490 patent because the curtain is secured to the outer surface of the chamber by a double-sided adhesive tape.

The attachment of the curtain (12) within the freshness chamber is also not adaptable to the device disclosed in the '490 patent. The securing technique disclosed in the '490 patent teaches the use of a double-sided adhesive tape to secure the curtain. Unfortunately the upper surface of the inner chamber is often times uneven and may have design characteristics such as vents, ducts or thermostat that prevent proper alignment of the curtain which can result in creation of gaps between the flaps.

In accordance with the present invention a thermal barrier for a cabinet (1) having a door storage area comprising a curtain (12) having vertical slits dividing the curtain into flaps; an attachment device (14) for securing the curtain within the cabinet (1); and a displacement apparatus (16) for displacing at least one of the flaps from alignment with adjacent flaps when the cabinet is closed allowing air within the freshness chamber (10) to circulate to the door storage area.

I. The Curtain

The curtain (12) may be made of any material known to those skilled in the art that has poor thermal conductance, a low ionic static charge storage capacity, and acts as a thermal insulator. The material used to construct the curtains is dependent on the temperature within the cabinet. In particular, the curtain (12) may be utilized for a variety of purposes such as for a refrigerator or oven. When the curtain (12) is to be utilized for a refrigerated chamber the curtain (12) is preferably made of a material that is able to retain a portion of its flexibility at low temperature such as below 32° F. to about −25° F. and may have a thickness of from about 0.004 mm to about 0.040 mm, preferably from about 0.01 mm to about 1.00 mm, and most preferably from about 0.01 mm to about 0.25 mm. Preferably the material is a polymer and most preferably a translucent polyvinyl or polypropylene polymer.

When the curtain (12) is to be utilized for a heated chamber the curtain (12) is preferably made of a material that is able to retain a portion of its rigidity at higher temperatures such as temperatures above 200° F. to about 500° F. and may have a thickness of from about 0.004 mm to about 0.040 mm, preferably from about 0.01 to about 1.00 mm, and most preferably from about 0.01 mm to about 0.25 mm. Preferably the material is a polymer such as silicone.

The curtain (12) may have one or more vertical slits dividing the curtain into flaps. The vertical slits may extend from the base of the curtain (12) to about the top of the curtain or may extend to the top of the curtain (12) dividing the curtain into separate distinct flaps. The flaps preferably are of the same length extending from the top of the cabinet (1) to the base of the cabinet (1) such that the chamber formed interferes with the circulation of ambient air with the temperature-controlled air within the freshness chamber (10). The flaps may have the same or differing widths ranging from about 2 inches to about 18 inches, preferably from about 3 inches to about 8 inches and most preferably about 4 inches to about 5 inches. The flaps may be aligned side by side or they may overlap. If the flaps overlap they may form an exterior flap layer and an interior flap layer.

II. The Attachment Device

The attachment device (14) may be any device known to those skilled in the art that may be used to secure the curtain to the inner chamber of the cabinet (1). In another configuration, the attachment device (14) may be composed of two or more parts that allow the curtain (12) to be affixed within the inner chamber such as for example a rod that supports the curtain (12) and at least one bracket for mounting the rod within the cabinet (1). In the first configuration the curtain (12) may be provided with connectors that allow the user to select and apply the desired connector to the curtain (12) and cabinet (1) For example providing the curtain (12) with self-laminating TM strip so that the user may attach one section of the strip to the upper portion of the curtain (12) near the top edge and the other section of the strip to the top wall of the cabinet (1). Once the Velcro™ sections are in place the curtain may be hung within the cabinet (1) by re-associating the Velcro™ sections.

In the other configuration the attachment device (14) comprises at least one mounting means and a connecting rod. The mounting means may be a bracket comprising one continuous piece that is aligned parallel to the connecting rod or may comprise two components one at each end of and generally perpendicular to the connecting rod. When the bracket is one continuous piece, the bracket may be constructed so that it is adjustable to fit a variety of cabinet (1) widths. For example the bracket may be composed of two sections wherein one section is slidably affixed within the other section similar to the telescoping curtain rods used in the window covering industry. Alternatively the two sections may be provided as two interconnecting pieces that may be secured in a desired length by nut and bolt or by clip.

The one continuous piece bracket may be secured to the top wall of the cabinet (1) or to the opposing sidewalls by a variety of methods such as screws, rivets, Velcro™, or adhesive. When two brackets are used they may be affixed one on each of two opposing side walls, preferably as close as possible to the top of the inner chamber and in close proximity to the door of the cabinet (1). The bracket may be constructed of any rigid material able to withstand a variety of temperature extremes as well as the weight of the curtain during such temperature extremes. Preferably the bracket is made of metal or temperature resistant polymer.

The connecting rod may be any rigid elongated shaft on which a curtain (12) or curtain flaps may be affixed, that may be mounted to the mounting means and allows at least one flap to be displaced from alignment with its adjacent flaps when the cabinet is closed. The connecting rod may be of fixed length or adjustable in length. If the connecting rod is adjustable it may be, for example, provided as two interconnecting pieces that may be secured in a desired length by nut and bolt or by push lock. The connecting rod may be mounted in the mounting means by a variety of methods known to those skilled in the art. For example, the mounting means may provide a cradle, clip or loop such that each end of the connecting rod may be placed into a cradle or attached to a clip or inserted into a loop. When in position the connecting rod may be stationary or may rotate. Alternatively, the connecting rod may be affixed to the mounting means and the mounting means may rotate. The curtain (12) or curtain flaps may be fastened to the connecting rod directly or it/they may be provided with an adapter on one end that may be slipped onto the connecting rod. For example an adapter may be created by folding over the top of the curtain or curtain flap to form a loop that may slip over the connecting rod. If the flaps or curtain (12) are fastened to the connecting rod so that they may be fastened directly to the rod for example by screw or adhesive, or they may be affixed to an adapter on the connecting rod such as for example a metal plate.

III. The Displacement Apparatus

The displacement apparatus (16) may be any apparatus known to those skilled in the art that allows at least one flap to be substantially removed from alignment with its adjacent flaps allowing the air within the cabinet (10) to circulate into the door storage area when the door is closed. For example a displacement apparatus (16) could be a protrusion strip that physically displaces the curtain flaps by pressing against the flaps when the door is closed. Alternatively, a mechanical displacing apparatus may be utilized that converts the mechanical energy created by closing or opening the door to activate the rotation of the connecting rod displacing one or more curtain flaps. In addition an electronic displacing apparatus may be utilized comprising a light sensor that activates an electronic motor causing the rotation of the connecting rod when the presence or absence of light is detected.

When the displacement apparatus (16) is a protrusion strip, any device that is able to be mounted to the cabinet door and able to push against at least one flap such that it is substantially displaced from contact with its adjacent flaps is preferable. In one configuration when the flaps of the thermal barrier overlap the protrusion strip pushes against the flaps of the interior flap layer. If the cabinet door comprises at least one shelf, the protrusion strip may be mounted to the shelf such that when the door is closed the protrusion strip displaces at least one curtain flap. The protrusion strip may be mounted to the cabinet door by a variety of methods including adhesive, snaps or Velcro™. The protrusion strip may be made of a variety of materials that maintain their structural integrity over a wide range of temperature variations, is/are able to displace a curtain flap without causing substantial structural alteration of the flap and able to withstand the force exerted by curtain. For example the protrusion strip may be made of a polymer or rubber. Preferably the strip is constructed of plastic and the protrusions constructed of rubber. The protrusion may be a set height or may be adjustable. A preferred height is one that allows the protrusion to contact at least one flap and displace it from alignment with adjacent flaps, preferably the height is from about one half inch to about three inches, preferably from one inch to two inches, and most preferably from about one and one half inches to about one and three quarters inches.

When a device is utilized to rotate the connecting rod the rod may be rotated by a variety of methods known to those skilled in the art including a device activated by the opening of the cabinet door or alternatively by the closing of the cabinet door. The rotating device may be activated mechanically or electrically. For example the device may be mechanical such that when the door is opened an activation rod is released that rotates the connecting rod such that the curtain flaps are realigned from their displaced position when the door was closed. Alternatively, the activation rod may rotate the connecting rod when the door is closed displacing one or more of the curtain flaps.

If the displacement apparatus (16) is mechanical it may comprise two springs, the first spring activates the connecting rod to rotate displacing at least one flap when the cabinet door is closed and a second spring activates the connecting rod to rotate in the opposing direction allowing the at least one flap is aligned with adjacent flaps when the door is open. Both springs may be affixed to the connecting rod such as by connecting one end of each spring to a tongue affixed to the connected rod. The other end of the first spring may then be connected to either the bracket or the cabinet. The other end of the second spring may be affixed to an activation shaft slidably connected to the bracket such that when the door is opened the pressure exerted by the door on the activation shaft is released and the connecting rod is rotated bringing the displaced flaps in contact with adjacent flaps. The bracket may further comprise a stopping component that prevents the connecting rod from rotating beyond the point in which the flaps are aligned when the door is open.

Correspondingly an electronic device that comprises a light sensor may be utilized to rotate the connecting rod. For example when a refrigerator door is opened the light inside the refrigerator illuminates, when this occurs the light sensor activates an electronic motor that rotates the connecting rod aligning the curtain flaps. Alternatively, the sensor may be activated by the absence of light such that when the cabinet door is closed the sensor registers the absence of light and the electronic motor is activated rotating the connecting rod and displacing at least one curtain flap. In these configurations one or more of the flaps may be connected directly to the connecting rod and thereby displaced when the connecting rod is rotated. The remaining flaps comprise adapters that allow the connecting rod to rotate freely without rotating these remaining flaps. The preferred form is for the flaps to alternate such that only every other flap is fastened directly to the connecting rod. The remaining flaps may be looped over the connecting rod such that when the connecting rod rotates the flaps fastened to the connecting rod rotate and are displaced while the remaining flaps do not rotate with the rod.

In another configuration the electronic motor may be activated by a push button located along the door jam such that when the door is closed the connecting rod is rotated displacing at least one flap and when the door is opened the connecting rod is rotated to re-align the flaps with other adjacent flaps.

IV. The Stabilizing Adapters

The stabilizing adapters (18) may be any adapters known to those skilled in the art that reduce flap movement during the opening and closing of the cabinet door yet allow the flaps to be displaced once the cabinet door is closed. For example the adapters (18) may be weights affixed or affixable near the base of the flaps or the adapter (18) may be an elastic cord that interconnects and aligns the base of the flaps. When the stabilizing adapters (18) are weights the weights may be provided in a variety of configurations and structures and may be affixed near the base of the flaps by a variety of methods such as snaps, clips, adhesive, magnetism, or by inserting a weight into a pocket provided at the center of the base of the flaps. The weights may be made of a variety of materials that increase the downward tension on the flap such as for example metal, high-density polymer, cement, stone or sand. The preferred weight is comprised of two components of equal weight that may be snapped together through an aperture made in the lower portion of the flap such that approximately one half of the stabilizing weight is on the interior side and the other is on the exterior side of the flap. Weights may not be required if the flap is constructed of a material heavy enough to prevent the movement of the flaps when the door is opened or closed.

When the stabilizing adapter (16) is an elastic cord, the cord may be affixed to the base of each flap by a variety of methods such as for example stitches, glue, or staples. Alternatively, the elastic cord may be affixed to the flaps by sliding the cord through a loop created at the base of the flap. The elastic cord may or may not be affixed to the interior cabinet. Preferably the elastic cord is affixed to the inner cabinet by for example tying the cord to metal loops attached to the inner cabinet sidewalls.

V. Installation

The controlled temperature within the door storage area of a cabinet may be maintained utilizing a thermal barrier of the present invention.

The thermal barrier device may be provided as a kit comprising a curtain (12), an attachment device (14), and a displacement apparatus (16). The curtain (12) may be provided as a single piece or as at least two flaps. In one preferred configuration the curtain (12) is provided as a single piece that is pre-slitted such that when cut into two pieces at 90° to the slits provides a curtain (12) with free hanging flaps for two different chambers such as a freshness chamber and freezer of a refrigerator. Alternatively, at least two separate flaps may be provided in which loops are preformed at each end such that they may be cut into two individual flaps. When two flaps are created from one, both flaps may be for the same compartment in the cabinet or they may be for different compartments such as one for a refrigerator and one for a freezer. Preferably the curtain (12) is provided on the connecting rod. In this configuration alternate flaps are affixed to the connecting rod such that when the connecting rod is rotated the affixed flaps are displaced.

The attachment device (14) may be selected from any of those that have the desired characteristics described above. Preferably the attachment device (14) comprises two brackets and an adjustable connecting rod. Preferably one of the two brackets further comprises a displacement apparatus (16) as described above. The two brackets are securely affixed to the two opposing sides such that the bracket comprising the displacement apparatus (16) is affixed to the wall adjacent to the door hinge and such that the connecting rod is parallel to the upper surface of the inner chamber.

The displacement apparatus (16) may be selected from any of those having the desired characteristics as described above. Preferably the displacement apparatus (16) is a mechanical device comprising an activation shaft affixed to a bracket and in contact with the connecting rod by a spring such that when the door is opened the activation shaft is released and the connecting rod is rotated bringing the displaced flaps in alignment with adjacent flaps. Correspondingly, when the door is closed the activation shaft is compressed and the connecting rod is rotated displacing at least one flap.

The kit may further comprise stabilizing adapters (18) as those described above. Preferably the adapters (18) have an attachment mechanism that allows penetration of the curtain upon installation at the base of the flaps.

Installation of the thermal barrier into a refrigerator will generally require that the user measure the width and height of the inner chamber, cut the curtain (10) to the corresponding width and height, mount the attachment device (14) making sure that the displacement apparatus (16) is positioned on the side wall adjacent to the door hinge, adjust the length of the connecting rod, and attach the connecting rod to the attachment device (14).

EXAMPLES

Example 1

Procedure for Determining the Temperature within the Freshness Chamber and the Door Storage Area for a Refrigerator With and Without a Curtain The test unit was an eighteen cubic feet Frigidaire Crown Series F44N18DT refrigerator with a freezer top. The temperature measurements were taken over a twelve-hour period and power measurements over a thirteen hour period, including a 1 hour steady state measurement. The electrical power was recorded at the compressor input with an Extech #382860 True RMS Power Multimeter plugged into the electrical circuit and the Frigidaire unit. Recording of the electrical current was taken every fifteen seconds and temperature was recorded every two minutes. The temperature readings were recorded with a Fluke 52 Series II Dual Thermocouple Thermometer. The dual thermocouple readings were taken at the upper interior storage door and the mid interior chamber area. Other temperature readings were taken with the Createware DR-80 industrial dial refrigerator/freezer thermometers. The Frigidaire cabinet conditions were as follows: the ambient room temperature was seventy degrees, the cabinet was level, there was an eighteen inch clearance area around the cabinet, the freezer was set at the warmest temperature setting, and the Frigidaire temperature was set to six on a one to nine scale with nine being the coldest.

The procedure was to open the refrigerator door between 45° and 90° for fifteen seconds at predetermined time points. The time points were as follows: no pulls during the first hour providing a steady state measurement, one pull during the second hour, eight pulls during the third hour at seven and one half minute increments; four pulls during the fourth hour at fifteen minute increments; four pulls during the fifth hour at fifteen minute increments, one pull during the sixth hour, one pull during the seventh hour, one pull during the eighth hour, one pull during the ninth hour, four pulls during the tenth hour at fifteen minute increments, four pulls during the eleventh hour at fifteen minute increments, eight pulls during the twelfth hour at seven and one half minute increments, and one time during the thirteenth hour.

Example 2

Cooling Efficiency Comparison of the Anti-Convection Current Curtain ('490) and a Thermal Barrier of the Present Invention in the Door Storage Area Following the Procedure Described in Example 1

Figure 3:
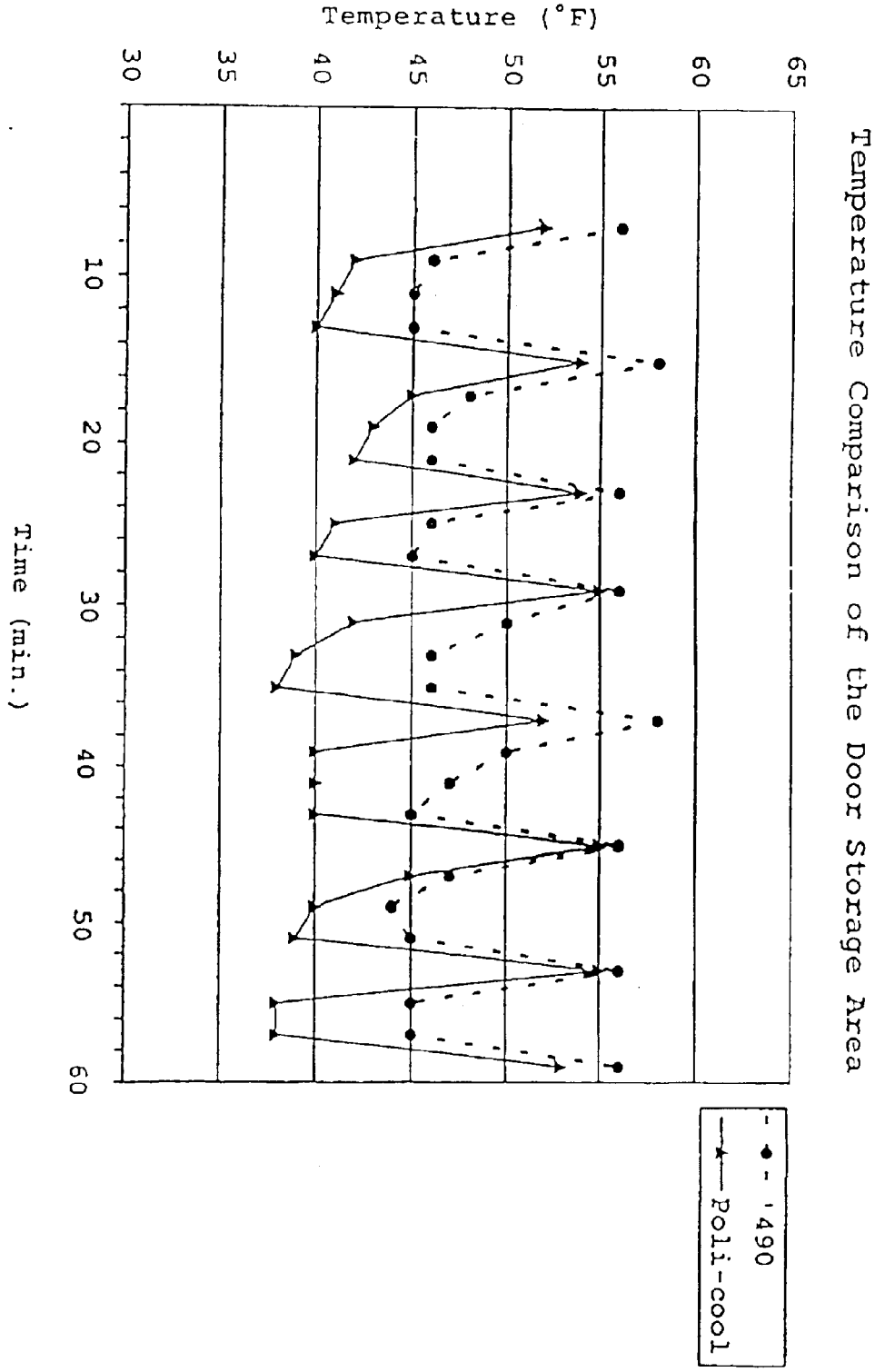
FIG. 3 is a graphical representation of temperature variation of the door storage area using the thermal barrier of the present invention versus the anti-convection current curtain of the '490 patent wherein the cabinet door is opened a set number of times over the thirteen hour test period.

Analysis was performed of hour 3 to determine the cooling efficiency of the storage area. Hour three comprised eight pulls at seven and one half-minute increments. Referring more specifically now to FIG. 3 the lowest temperature within each seven and one half-minute cycle was averaged to determine the average low obtained by each device. Results show that the device disclosed in the '490 patent was able to cool the storage door to an average temperature of 45.1° F. during the seven and one half minute cycle. In contrast the present invention cooled the storage door to an average temperature of 39.6° F. during the seven and one half-minute cycle significantly below the FSIS safety recommendation of 45° F. This study suggests that the present invention is more efficient that the device disclosed in the '490 patent at retaining the set temperature within the storage door.

Example 3

Cooling Efficiency Comparison of the Anti-Convection Current Curtain ('490) and a Thermal Barrier of the Present Invention in the Freshness Chamber Following the Procedure Described in Example 1

Figure 4:
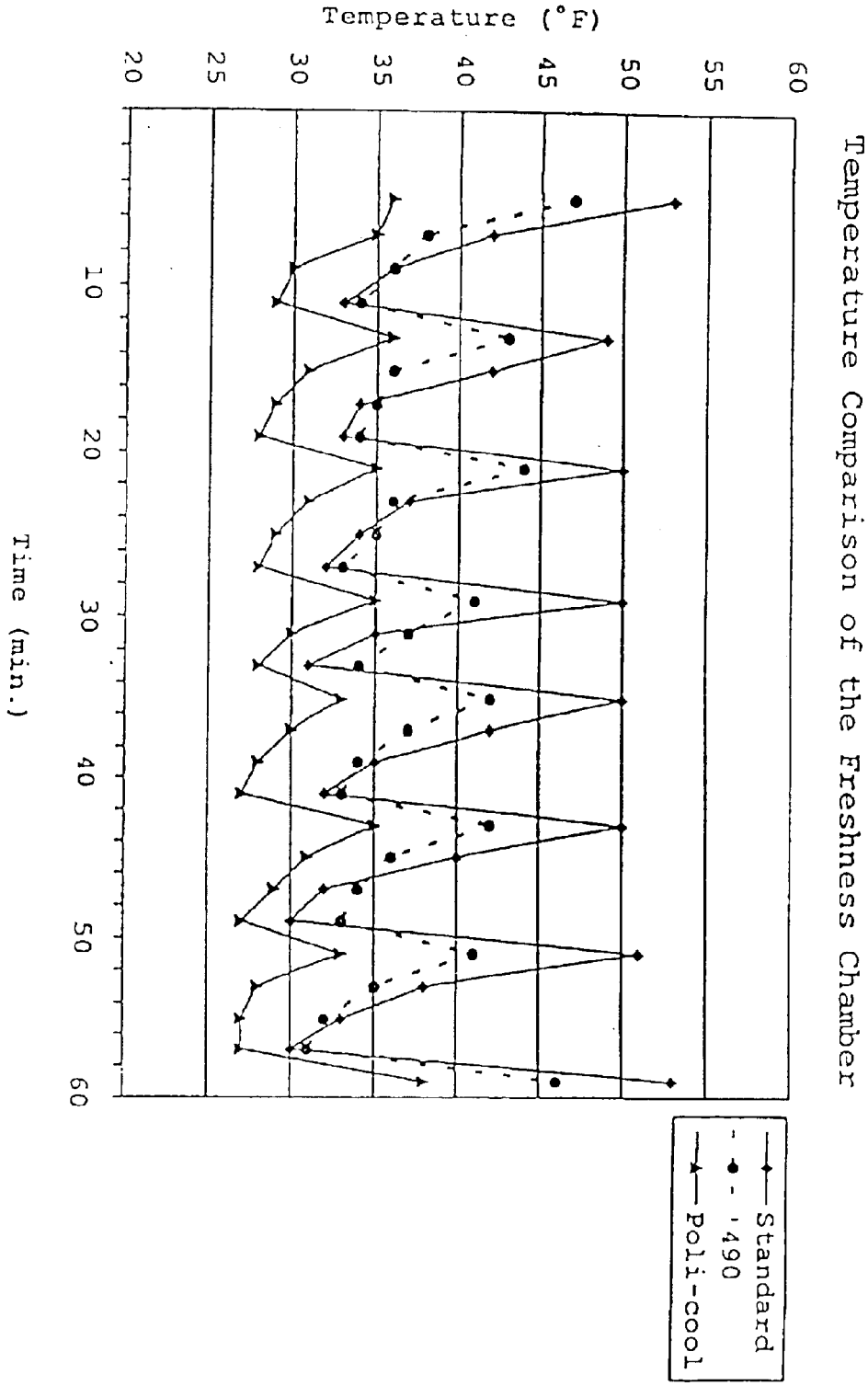
FIG. 4 is a graphical representation of temperature variation of the freshness chamber using the thermal barrier of the present invention versus the anti-convection current curtain of the '490 patent wherein the cabinet door is opened a set number of times over the thirteen hour test period.

Further analysis was performed of hour twelve to determine the efficiency of each device in retaining the set temperature within the freshness chamber. Hour twelve comprised eight pulls at seven and one half-minute increments. Referring more specifically now to FIG. 4 the highest temperature within each seven and one half-minute cycle was averaged to determine the average high obtained by each device. Results show that the standard refrigerator had an average high of 50.8° F., the device disclosed in the '490 patent had an average high temperature of 43.7° F., and the present invention had an average high of 35.2° F. This study demonstrates that the present invention is more efficient at retaining the temperature within the freshness chamber than a standard refrigerator and the device disclosed in the '490 patent.

Example 4

Power Use Results from Testing the '490 Device and the Present Invention versus a Control (No Barrier) According to the Procedure in Example 1

Figure 5:
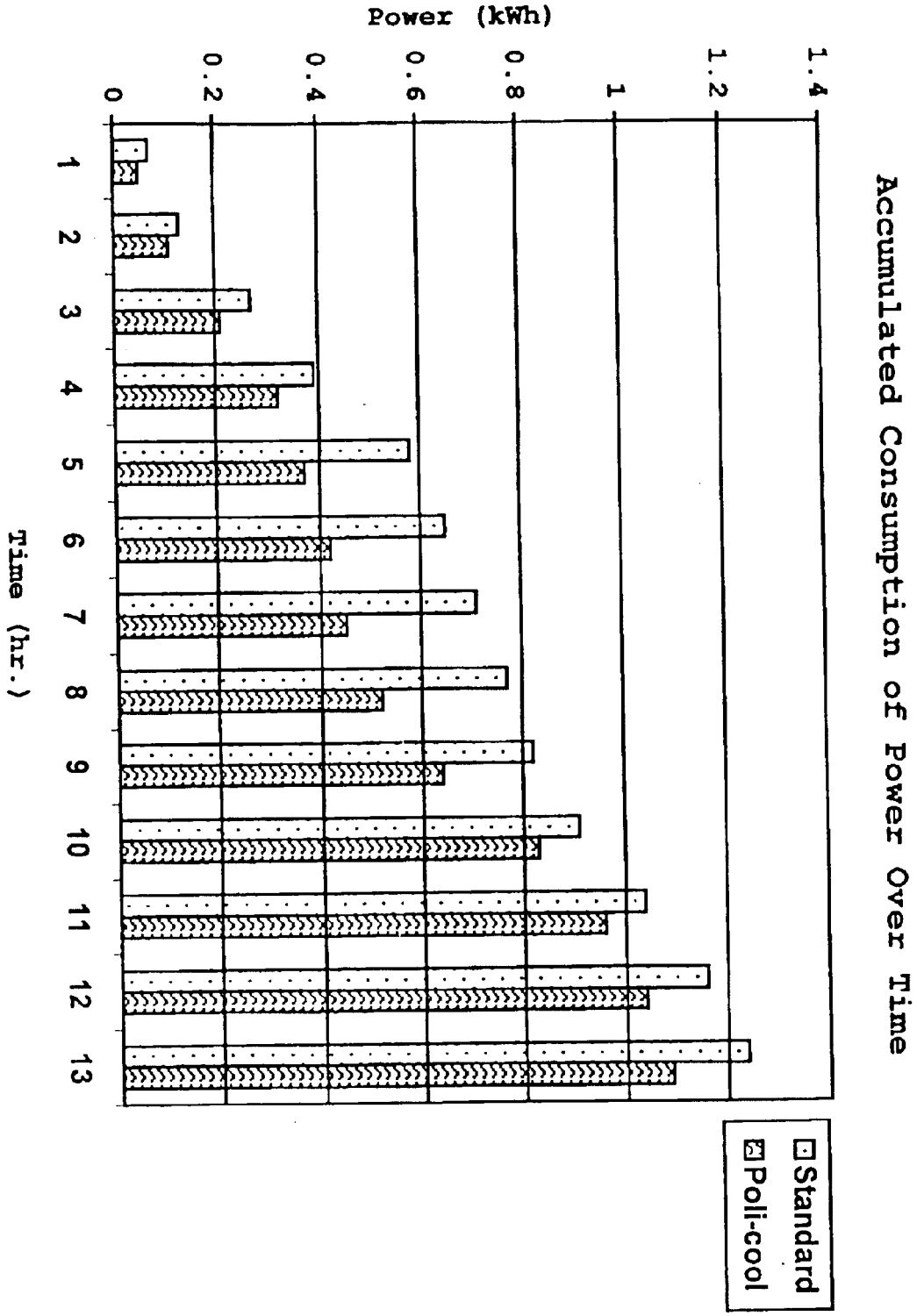
FIG. 5 is a graphical representation of power usage variation in kiloWatt hours during the twelve hour testing period using the thermal barrier of the present invention versus the anti-convection current curtain of the '490 patent.
Figure 6:
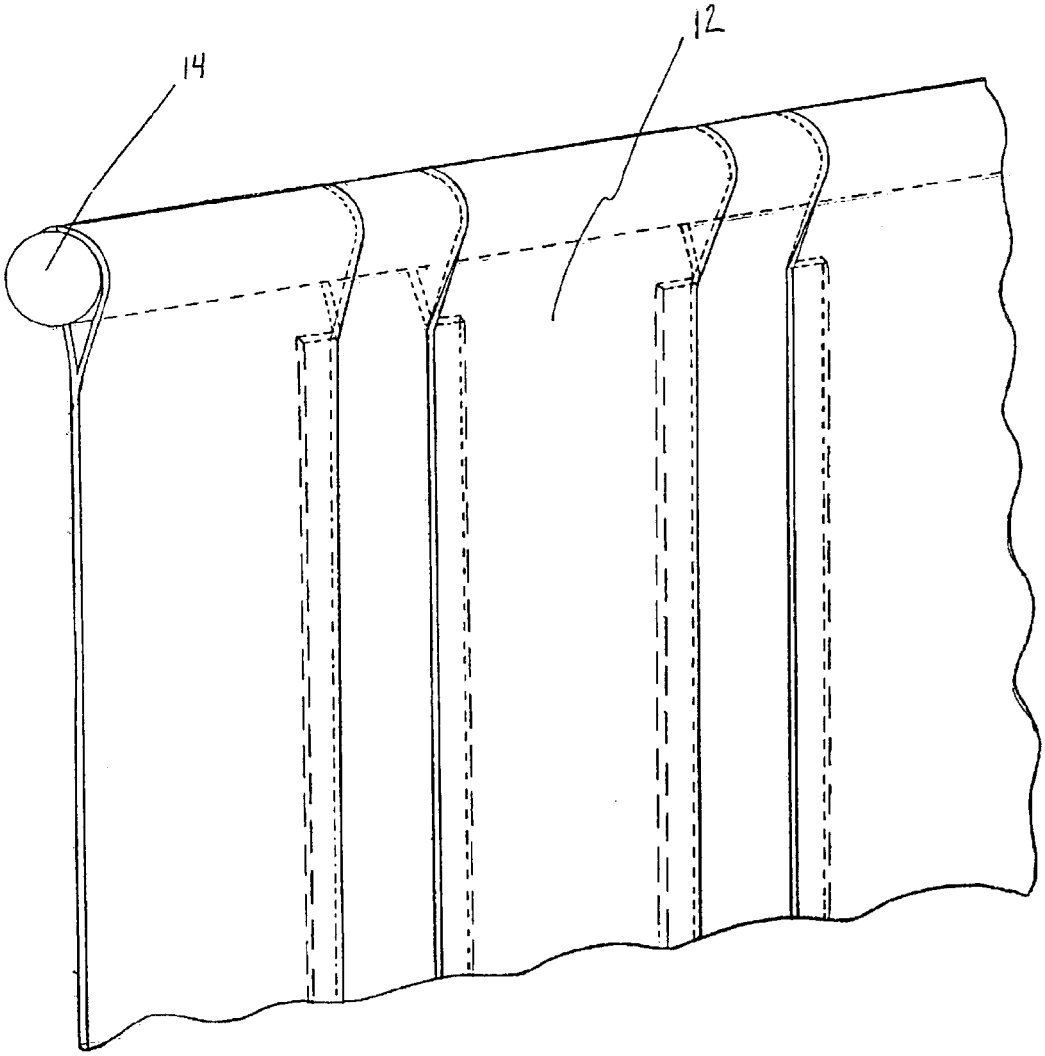
FIG. 6 is a perspective view of the overlapping flaps of the thermal barrier of the present invention showing interior and exterior chamber flaps (12).
Figure 7:
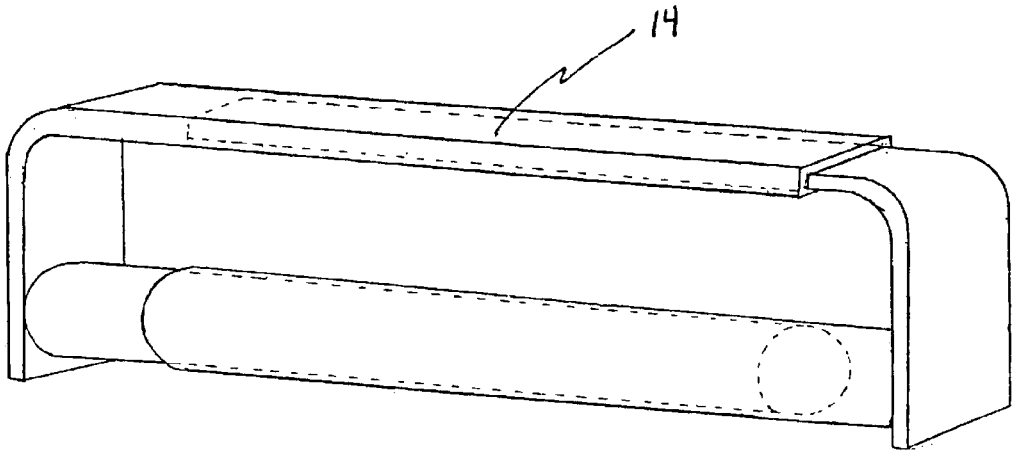
FIG. 7 is a perspective view of the mounting means and adjustable connecting rod of the thermal barrier of the present invention.
Figure 8:
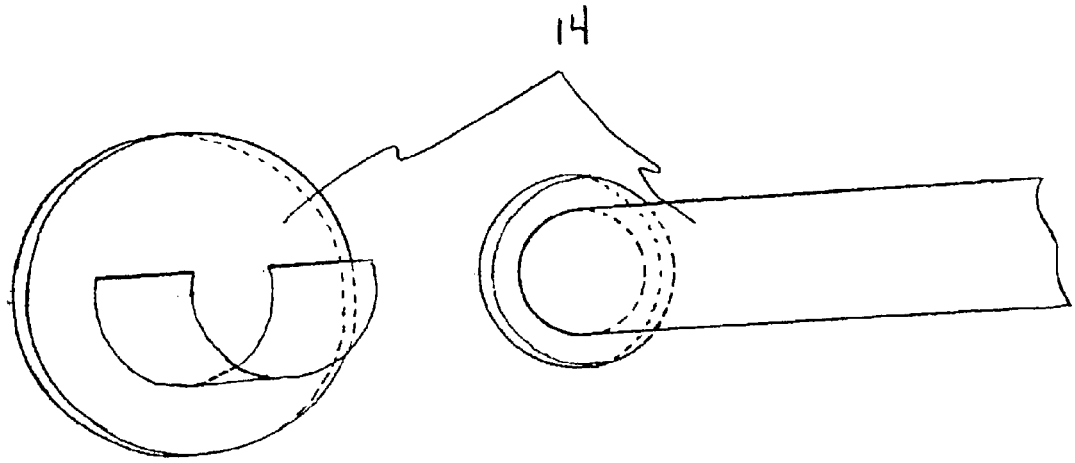
FIG. 8 is a perspective view of the mounting means of the thermal barrier of the present invention for attachment to the sidewalls of the cabinet.

Power consumption was measured over the thirteen hour testing period to compare the power required by a standard refrigerator and a refrigerator equipped with the thermal barrier of the present invention. Referring now specifically to FIG. 5 the results demonstrate that the standard refrigerator consumed 1.24 kWh while the refrigerator equipped with the thermal barrier of the present invention consumed only 1.09 kWh over the thirteen hour test period. Consequently, the refrigerator equipped with the thermal barrier of the present invention utilized 12.10% less power than the standard refrigerator.

I claim:

1. A thermal barrier for a cabinet having an inner chamber and a door hingably affixed to said cabinet said door having an interior side, wherein said interior side of said door contains a storage area, the thermal barrier comprising:

a) a curtain having vertical slits dividing said curtain into flaps;

b) an attachment device for securing said curtain within said cabinet wherein said attachment device comprises a mounting means and a connecting rod wherein said connecting rod is rotatably affixed to said mounting means; and c) a displacement apparatus, wherein said displacement apparatus comprises an electrical motor connected to said connecting rod and a light sensor such that when the cabinet door is closed the sensor activates said motor to rotate said connecting rod causing the displacement of at least one flap from alignment with an adjacent flap allowing air within said cabinet inner chamber to circulate to said door storage area.

2. A thermal barrier according to claim 1 wherein said flaps further comprise stabilizing adapters.

3. A thermal barrier according to claim 2 wherein said stabilizing adapters are weights.

4. A thermal barrier according to claim 1 wherein said inner chamber having an upper surface, a lower surface and two opposing side walls, and wherein said mounting means is for securing said curtain to said side walls.

5. A kit comprising a thermal barrier according to claim 4 further comprising stabilizing adapters for said flaps.

6. A thermal barrier according to claim 1 wherein said inner chamber having an upper surface, a lower surface and two opposing side wall.

7. A thermal barrier for a cabinet having an inner chamber and a door hingably affixed to said cabinet said door having an interior side, wherein said interior side of said door contains a storage area, the thermal barrier comprising:

a) a curtain having vertical slits dividing said curtain into flaps;

b) an attachment device for securing said curtain within said cabinet wherein said attachment device comprises a mounting means and a connecting rod wherein said connecting rod is rotatably affixed to said mounting means; and c) a displacement apparatus, wherein said displacement apparatus comprises an electrical motor connected to said connecting rod and a light sensor such that when the cabinet door is opened the sensor activates said motor to rotate said connecting rod causing at least one flap to align with an adjacent flap allowing air within said cabinet inner chamber to circulate to said door storage area.

8. A thermal barrier according to claim 1 wherein said flaps further comprise stabilizing adapters.

9. A thermal barrier according to claim 8 wherein said stabilizing adapters are weights.

10. A thermal barrier according to claim 7 wherein said inner chamber having an upper surface, a lower surface and two opposing side walls, and wherein said mounting means is for securing said curtain to said side walls.

11. A kit comprising a thermal barrier according to claim 10 further comprising stabilizing adapters for said flaps.

12. A thermal barrier according to claim 7 wherein said inner chamber having an upper surface, a lower surface and two opposing side wall.

13. A thermal barrier for a cabinet having an inner chamber and a door hingably affixed to said cabinet, said door having an interior side, wherein said interior side of said door contains a storage area, the thermal barrier comprising:

a) a curtain having vertical slits dividing said curtain into flaps;

b) an attachment device for securing said curtain within said cabinet wherein said attachment device comprises a mounting means and a connecting rod wherein said connecting rod is rotatably affixed to said mounting means; and c) a displacement apparatus, wherein said displacement apparatus comprises an activation shaft connected to said connecting rod such that when the cabinet door is closed said activation shaft activates said connecting rod rotating said connecting rod causing the displacement of at least one flap from alignment with adjacent flaps allowing air within said cabinet inner chamber to circulate to said door storage area.

14. A thermal barrier according to claim 13 wherein said flaps further comprise stabilizing adapters.

15. A thermal barrier according to claim 14 wherein said stabilizing adapters are weights.

16. A thermal barrier according to claim 13 wherein said inner chamber having an upper surface, a lower surface and two opposing side walls, and wherein said mounting means is for securing said curtain to said side walls.

17. A kit comprising a thermal barrier according to claim 16 further comprising stabilizing adapters for said flaps.

18. A thermal barrier according to claim 13 wherein said inner chamber having an upper surface, a lower surface and two opposing side wall.

19. A thermal barrier for a cabinet having an inner chamber and a door hingably affixed to said cabinet, said door having an interior side, wherein said interior side of said door contains a storage area, the thermal barrier comprising:

a) a curtain having vertical slits dividing said curtain into flaps;

b) an attachment device for securing said curtain within said cabinet wherein said attachment device comprises a mounting means and a connecting rod wherein said connecting rod is rotatably affixed to said mounting means; and c) a displacement apparatus wherein said displacement apparatus comprises an activation shaft connected to said connecting rod such that when the cabinet door is opened said activation shaft activates said connecting rod rotating said connecting rod causing at least one flap to align with adjacent flaps allowing air within said cabinet inner chamber to circulate to said door storage area.

20. A thermal barrier according to claim 19 wherein said flaps further comprise stabilizing adapters.

21. A thermal barrier according to claim 20 wherein said stabilizing adapters are weights.

22. A thermal barrier according to claim 13 wherein said inner chamber having an upper surface, a lower surface and two opposing side walls, and wherein said mounting means is for securing said curtain to said side walls.

23. A kit comprising a thermal barrier according to claim 22 further comprising stabilizing adapters for said flaps.

24. A thermal barrier according to claim 19 wherein said inner chamber having an upper surface, a lower surface and two opposing side wall.

25. A method for reducing the temperature within a door storage area of a cabinet comprising the steps of affixing a thermal barrier to a cabinet having an inner chamber and a door hingably affixed to said cabinet, said door having an interior side wherein said interior side of said door contains a storage area, said thermal barrier comprising a curtain having vertical slits dividing said curtain into flaps; an attachment device for securing said curtain within said cabinet, wherein said attachment device comprises a mounting means and a connecting rod wherein said connecting rod is rotatably affixed to said mounting means; and a displacement apparatus for displacing at least one of said flaps from alignment with adjacent flaps when said cabinet door is closed allowing air within said cabinet inner chamber to circulate to said door storage area) wherein said displacement apparatus comprises an electrical motor connected to said connecting rod and a light sensor such that when the cabinet door is closed the sensor activates said motor to rotate said connecting rod causing the displacement of at least one flap from alignment with said adjacent flap.

26. A method for reducing the temperature within a door storage area of a cabinet comprising the steps of affixing a thermal barrier to a cabinet having an inner chamber and a door hingably affixed to said cabinet, said door having an interior side wherein said interior side of said door contains a storage area said thermal barrier comprising a curtain having vertical slits dividing said curtain into flaps; an attachment device for securing said curtain within said cabinet, wherein said attachment device comprises a mounting means and a connecting rod wherein said connecting rod is rotatably affixed to said mounting means; and a displacement apparatus for displacing at least one of said flaps from alignment with adjacent flaps when said cabinet door is closed allowing air within said cabinet inner chamber to circulate to said door storage area, wherein said displacement apparatus comprises an electrical motor connected to said connecting rod and a light sensor such that when the cabinet door is opened the sensor activates said motor to rotate said connecting rod causing said at least one flap to align with said adjacent flap.

27. A method for reducing the temperature within a door storage area of a cabinet comprising the steps of affixing a thermal barrier to a cabinet having an inner chamber and a door hingably affixed to said cabinet, said door having an interior side wherein said interior side of said door contains a storage area, said thermal barrier comprising a curtain having vertical slits dividing said curtain into flaps; an attachment device for securing said curtain within said cabinet, wherein said attachment device comprises a mounting means and a connecting rod, wherein said connecting rod is rotatably affixed to said mounting means; and a displacement apparatus for displacing at least one of said flaps from alignment with adjacent flaps when said cabinet door is closed allowing air within said cabinet inner chamber to circulate to said door storage area, wherein said displacement apparatus comprises an activation shaft connected to said connecting rod such that when the cabinet door is closed said activation shaft activates said connecting rod rotating said connecting rod causing the displacement of at least one flap from alignment with said adjacent flaps.

28. A method for reducing the temperature within a door storage area of a cabinet comprising the steps of affixing a thermal barrier to a cabinet having an inner chamber and a door hingably affixed to said cabinet, said door having an interior side, wherein said interior side of said door contains a storage area, said thermal barrier comprising a curtain having vertical slits dividing said curtain into flaps; an attachment device for securing said curtain within said cabinet wherein said attachment device comprises a mounting means and a connecting rod, wherein said connecting rod is rotatably affixed to said mounting means; and a displacement apparatus for displacing at least one of said flaps from alignment with adjacent flaps when said cabinet door is closed allowing air within said cabinet inner chamber to circulate to said door storage area, wherein said displacement apparatus comprises an activation shaft connected to said connecting rod such that when the cabinet door is opened said activation shaft activates said connecting rod rotating said connecting rod causing said at least one flap to align with said adjacent flaps.

29. A kit comprising a thermal barrier for a cabinet having an inner chamber and a door hingably affixed to said cabinet said door having an interior side wherein said interior side of said door contains a storage area, said kit comprising a curtain having vertical slits dividing said curtain into flaps, an attachment device for securing said curtain within said cabinet, wherein said attachment device comprises a mounting means and a connecting rod wherein said connecting rod, is rotatably affixed to said mounting means, and a displacement apparatus, wherein said displacement apparatus comprises an electrical motor connected to said connecting rod and a light sensor such that when the cabinet door is closed the sensor activates said motor to rotate said connecting rod causing the displacement of at least one flap from alignment with an adjacent flap allowing air within said cabinet inner chamber to circulate to said door storage area.

30. A kit comprising a thermal barrier for a cabinet having an inner chamber and a door hingably affixed to said cabinet, said door having an interior side, wherein said interior side of said door contains a storage area, said kit comprising a curtain having vertical slits dividing said curtain into flaps, an attachment device for securing said curtain within said cabinet, wherein said attachment device comprises a mounting means and a connecting rod, wherein said connecting rod is rotatably affixed to said mounting means, and a displacement apparatus, wherein said displacement apparatus comprises an electrical motor connected to said connecting rod and a light sensor such that when the cabinet door is opened the sensor activates said motor to rotate said connecting rod causing at least one flap to align with an adjacent flap allowing air within said cabinet inner chamber to circulate to said door storage area.

31. A kit comprising a thermal barrier for a cabinet having an inner chamber and a door hingably affixed to said cabinet, said door having an interior side, wherein said interior side of said door contains a storage area, said kit comprising a curtain having vertical slits dividing said curtain into flaps, an attachment device for securing said curtain, within said cabinet wherein said attachment device comprises a mounting means and a connecting rod, wherein said connecting rod is rotatably affixed to said mounting means, and a displacement apparatus, wherein said displacement apparatus comprises an activation shaft connected to said connecting rod such that when the cabinet door is closed said activation shaft activates said connecting rod rotating said connecting rod causing the displacement of at least one flap from alignment with adjacent flaps allowing air within said cabinet inner chamber to circulate to said door storage area.

32. A kit comprising a thermal barrier for a cabinet having an inner chamber and a door hingably affixed to said cabinet, said door having an interior side, wherein said interior side of said door contains a storage area, said kit comprising a curtain having vertical slits dividing said curtain into flaps, an attachment device for securing said curtain within said cabinet, wherein said attachment device comprises a mounting means and a connecting rod, wherein said connecting rod is rotatably affixed to said mounting means, and a displacement apparatus, wherein said displacement apparatus comprises an activation shaft connected to said connecting rod such that when the cabinet door is opened said activation shaft activates said connecting rod rotating said connecting rod causing said at least one flap to align with adjacent flaps allowing air within said cabinet inner chamber to circulate to said door storage area.

* * * * *